United States Patent [19]

Csák

[11] Patent Number: 4,638,609

[45] Date of Patent: Jan. 27, 1987

[54] SYSTEM FOR REDUCING THE SEISMIC LOAD OF TALL BUILDINGS

[75] Inventor: Béla Csák, Budapest, Hungary

[73] Assignee: Budapest Muszaki Egyetem, Budapest, Hungary

[21] Appl. No.: 623,715

[22] Filed: Jun. 22, 1984

[30] Foreign Application Priority Data

Jun. 7, 1984 [HU] Hungary ..... 2202/84

[51] Int. Cl.[4] ..... E02D 27/34

[52] U.S. Cl. ..... 52/167

[58] Field of Search ..... 52/167, 293, 83, 227, 52/230, 245; 14/16.1; 267/136, 141

[56] References Cited

U.S. PATENT DOCUMENTS

| | | | |
|---|---|---|---|
| 3,738,633 | 6/1973 | Pineau | 267/141 |
| 3,813,835 | 6/1974 | Rice | 52/227 |
| 3,916,578 | 11/1975 | Forootan et al. | 52/167 |
| 4,258,516 | 3/1981 | Mori et al. | 52/167 X |
| 4,468,016 | 8/1984 | Pineau | 267/141 |
| 4,479,336 | 10/1984 | Schoening et al. | 52/245 X |

FOREIGN PATENT DOCUMENTS

| | | | |
|---|---|---|---|
| 715757 | 2/1980 | U.S.S.R. | 52/167 |
| 726280 | 4/1980 | U.S.S.R. | 52/167 |

*Primary Examiner*—Carl D. Friedman
*Assistant Examiner*—Creighton Smith
*Attorney, Agent, or Firm*—Handal & Morofsky

[57] ABSTRACT

Cables are provided between the foundation and the superstructure and arranged in the vertical cavities of the foundation and the superstructure and, both of their ends are provided with head pieces wider than the diameter of the cavities and elastic padding or padding elements are installed in the upper head piece. The diameter of the cavities in the foundation is increasing upwards, while in the superstructure it is increasing downwards. The elastic padding elements may be rubber and/or neoprene discs and are arranged along the upper enlarged section of the cavities in the superstructure.

2 Claims, 1 Drawing Figure

SYSTEM FOR REDUCING THE SEISMIC LOAD OF TALL BUILDINGS

FIELD AND BACKGROUND OF THE INVENTION

Subject of the present invention is a system for reducing the seismic load of tall buildings with high centre of gravity, and to prevent the tipping over of building provided with elastic elements between the foundation and the superstucture.

It is generally known that the various buildings are exposed to seismic loads when accelerating motions occur in parts of the building acted upon the effects of seismic shocks.

One way of reducing the seismic forces is the reduction of the mass of the buildings, significant results were accomplished in this area with the developments in the architecture field.

Another possible method of reducing the seismic forces is providing an intermediate system between the building foundation and the superstucture, which is suitable for absorption of the energy produced during the seismic shocks. The various methods for reduction of the seismic load essentially follow this pattern.

It is known to build in horizontal wall reinforcements between the foundation and the upper wall surface, which break up in the wake of the seismic motion, and the so produced deformations absorb a certain part of the energy. These walls are constructed by using mortar for joining the building units suitable to withstand extreme deformations.

In some cases energy-absorbing paddings are installed between the foundation and the superstructure, as well as between the foundation and the ground. Rollers of limited motion are installed between the foundation and the superstructure. Sliding panels made of synthetic material are arranged between the foundation and the ground according to one of these methods.

In other cases, steel elements withstanding the torsional and longitudinal deformations are built in between the ground and the building foundation.

Sometimes, sandwich type rubber springs are installed between the building foundation and the superstructure.

The energy may be absorbed by the deformation of reinforced concrete pillars as well. Again according to another method so-called disengaging joints are built in on the ground floor of the building. These are characterized in that they become ruined in case of forces exceeding the specified limit force thus preventing the development of the excessive horizontal accelerations and their transfer to the superstructure.

Different shock absorbers are described in the Swiss Pat. No. 584 333 and in the U.S. Pat. No. 394,895.

According to another method see for instance the European patent application No. 005 6258, a spring system is built in between the foundation and the superstructure, which enables the development of seismic forces equivalent maximally to the horizontal forces developed from the wind load. In case of more intensive forces the spring system yields, consequently becoming automatically unsuitable for the transfer of higher forces as a result of its own plastic deformation. The spring system includes a motion-damping part of high elastic deformation capacity, and a highly effective plastic energy-absorbing part. The motion-damping part is formed as a set of steel mandrels extending into the surfaces of the foundation and the superstructure facing each other, and these steel mandrels are unsuitable for absorption of the loads higher than those developed from the maximal wind load.

All these methods are based on building in the energy-absorbing elastic elements between the foundation and the meaming that the foundation and the superstructure are separated from each other so that the foundation is capable of moving in a horizontal direction in relation to the superstructure.

These methods eliminate by necessity or at least reduce considerably the connection ensuring the vertical cementing, anchoring force between the foundation and the superstructure.

In view of the fact that the resultant of the horizontal seismic forces produced by the seismic acceleration reacts in the centre of the building, it depends on the proportions of the building whether it results in a tipping over effect. In case of towery buildings with high centre of gravity this problem is significant, because the elastic connections serving the absorption of the seismic forces reduce the stability of the anchorage.

SUMMARY OF THE INVENTION

It is , accordingly the object of the present invention for provide a method suitable to preventing the tipping over of towery buildings with high centre of gravity even when the building is provided with elastic elements between the foundation and the superstructure to reduce the seismic loads.

According to the invention, fixing cables are placed between the foundation and the and are arranged in the vertical cavities of the foundation and the superstructure. They are also provided with a head piece wider than the diameter of the cavities, and an elastic padding is arranged below the upper head piece.

The diameter of the cavities in the foundation formed for receiving the cables is increased as it extends upwards, and the diameter of those in the superstructure is increased as it extends downwards. This way the cables can not press against the sides of the receiving cavities and remain straight between the fixed end-points during the horizontal motions.

The elastic padding elements under the head pieces of the cables are preferably rubber or neoprene discs arranged along the upper enlarged sections of the cavities in the superstructure.

The system according to the invention does not influence the relative horizontal displacement of the foundation and the superstructure, however, it prevents the building from tipping over upon the forces induced by the seismic acceleration. This way it makes the use of the earlier known elastic elements considerably safer.

BRIEF DESCRIPTION OF THE DRAWING

Other objects and advantages of the invention are explained in the following description and drawing. The drawing shows the construction of the system according to the invention.

DESCRIPTION OF THE PREFERRED EMBODIMENT

Figure 1:
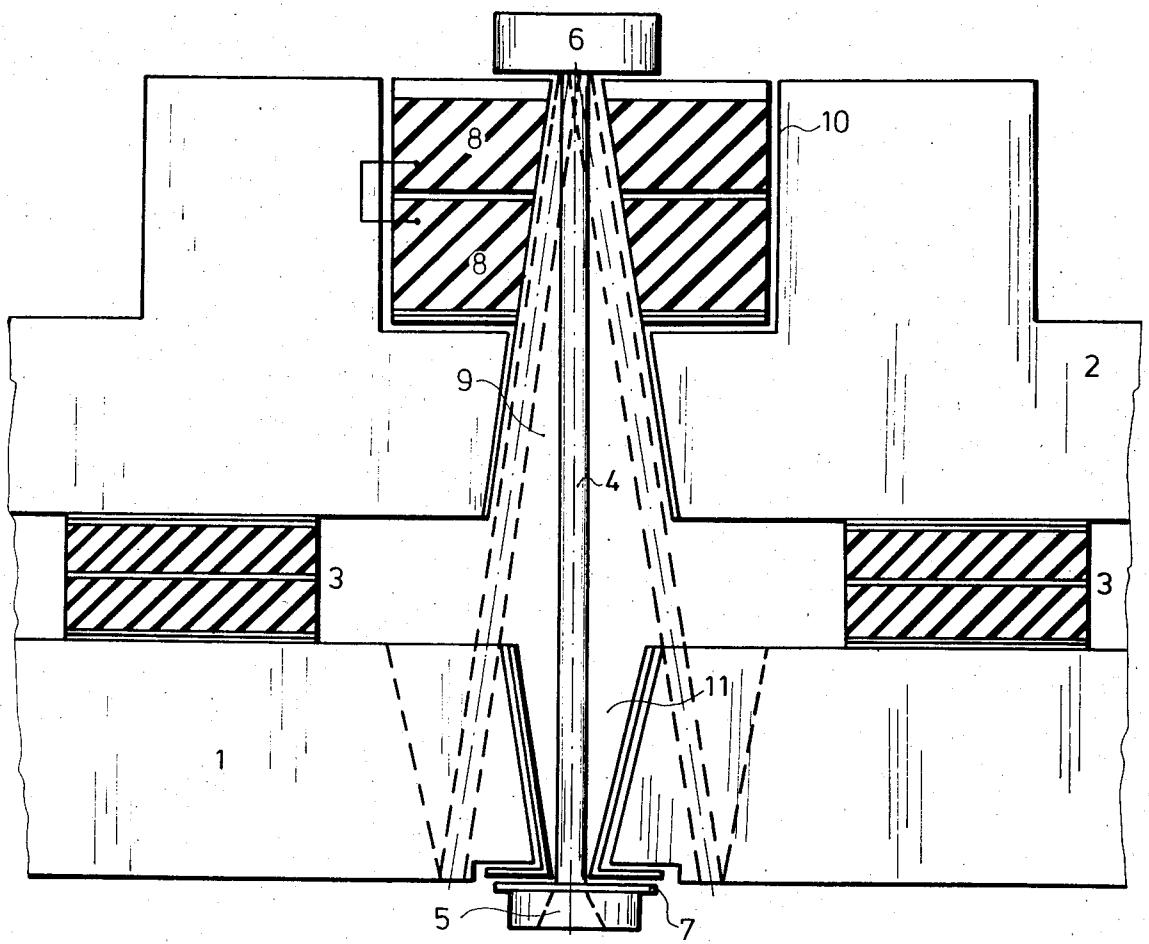

The demonstrated construction is obviously only a single element of the system ensuring the shock absorption and the anchorage. Energy-absorbing spring elements 3 ensuring the horizontal motions are built in between the foundation 1 and the superstructure 2 of the building. These carry the total vertical load of the building. The spring elements 3 are dimensioned for the vertical load as to be suitable for excess compressive stresses developed from the tipping along the extreme compressed strand of the building cross section. These elements have no tensile strenth. On account of the optional direction of the seismic shocks it is necessary take into account the tipping along optional vertical plane. This has to be taken into consideration with the distribution of the spring elements arranged in the extreme strands of the buildings cross section.

The tensioned connection between the foundation 1 and the superstructure 2 is ensured by cables 4 of high strength. These cables 4 are connected to the ceiling panels and to the supporting structures of the foundation 1 and superstructure 2 with a rigid joint on one end and with a flexible joint on the other end.

The cable 4 is held by a lower head piece 5 and an upper head piece 6. The lower head piece 5 is fitted into the nest 7 of the foundation 1 and it prevents the cable 4 from moving out of the foundation 1. The joint—as shown in the diagram—is rigid.

The upper head piece 6 is similar to the lower head piece 5, but this is flexibly fixed. It allows the tipping of the upper rigid part of the building along the elastic bedding and the displacement of the superstructure 2 in relation to the upper head piece 6 during tipping.

The flexible joint is provided with elastic paddings 8 below the head piece 6. These may be elastic neoprene discs arranged along the enlarged upper section 10 of the cavity 9 of the superstructure 2.

The elastic bedding is ensured by the deformation capacity of the compressed elements and by the flexible anchorage of the tensioned cable-ends. Since the direction of the seismic shocks is optional, thus the direction of the tipping too is optional. This has to be taken into account by the distribution of the anchoring cable elements which—similarly to the compressed elements—are arranged along the full circumference of the building cross section. Their number and size are such as to ensure with adequate safety the fixing of the upper part of the building to the foundation, its stability against tipping over even in case of the most intensive seismic shocks.

Since 1–10 cm relative displacements have to be dealt with between the foundation 1 and the superstructure 2 during the earthquakes, the cavities 9 and 11 receiving the cables 4 are formed to be conical. Similarly the elastic paddings 8 are also provided with conical cavities. Thus during the horizontal displacements taking place in the course of seismic shocks, the cable 4 can not press against the cavities 9 and 11 of the foundation 1 and superstructure 2. The positions of the cable 4 during the horizontal displacements of the foundation 1 are shown with dashed line in the diagram. As seen the cable 4 remain straight throughout between the end points during the horizontal movements.

The originally vertical cable will be in oblique position during the horizontal displacements, as a result of which the originally vertical right angle side of a triangle will become the subtense of the same triangle. This change of dimension is compensated not by the elongation of the cable, but by the vertical compression of the neoprene spring ensuring the flexible anchorage. The cable suffers plastic deformation of calculable extent along its longitudinal axis, as well, and that can also be taken into consideration.

Since upon the effect of the optional seismic shocks the direction of the horizontal movements too will be optional, such movements of the originally vertical cable can be ensured by its flexibility without increasing the tension. For this reason the use of cables is expedient.

The demonstrated example clearly shows that the system according to the invention is very simple, and at the same time, it enables safe anchorage for the building provided with elastic elements between the foundation and the superstructure in order to reduce the seismic loads. The production and installation of the cables require minimal excess investment, thus their use is not only safe but economical as well.

What we claim is:

1. In a system for reducing the seismic loads of tall buildings having a foundation and a superstructure with high centre of gravity and to prevent the tipping over of buildings, the improvement comprising elastic elements provided between the foundation and the superstructure, vertical cavities (9,11) having a predetermined diameter formed in the foundation (1) and in the superstructure (2), means for mounting cables (4) in said cavities between the foundation (1) and the superstructure (2), both ends of said cables being provided with lower and upper head pieces (5,6) wider than the diameter of the cavities (9,11), and elastic padding means installed in the upper head piece (6), wherein the diameter of the cavities (11) in the foundation (1) is increasing upwards.

2. In a system for reducing the seismic loads of tall buildings having a foundation and a superstructure with high centre of gravity and to prevent the tipping over of buildings, the improvement comprising elastic elements provided between the foundation and the superstructure, vertical cavities (9,11) having a predetermined diameter formed in the foundation (1) and in the superstructure (2), means for mounting cables (4) in said cavities between the foundation (1) and the superstructure (2), both ends of said cables being provided with lower and upper head pieces (5,6) wider than the diameter of the cavities (9,11), and elastic padding means installed in the upper head piece (6), wherein the diameter of the vertical cavities (9) in the superstructure (2) is increasing downwards.

* * * * *